US005651665A

United States Patent [19]

Can et al.

[11] Patent Number: 5,651,665

[45] Date of Patent: Jul. 29, 1997

[54] ADJUSTABLE RELIEF VALVE ARRANGEMENT FOR A MOTOR VEHICLE POWER STEERING HYDRAULIC PUMP SYSTEM

[75] Inventors: Ali Devrim Can, Simpsonville, S.C.; James Leroy Davison, Freeland, Mich.

[73] Assignee: General Motors Corporation, Detroit, Mich.

[21] Appl. No.: 746,528

[22] Filed: Nov. 12, 1996

[51] Int. Cl.[6] ..... F04B 49/22

[52] U.S. Cl. ..... 417/300; 417/307; 417/311; 417/440

[58] Field of Search ..... 417/300, 307, 417/308, 310, 311, 440; 137/117

[56] References Cited

U.S. PATENT DOCUMENTS

| | | | |
|---|---|---|---|
| 2,996,013 | 8/1961 | Thompson et al. . | |
| 3,200,752 | 8/1965 | Clark et al. | 417/300 |
| 3,207,077 | 9/1965 | Ziegler et al. | 103/42 |
| 3,385,220 | 5/1968 | Dymond | 417/300 |
| 3,656,870 | 4/1972 | Kusakabe et al. | 417/300 |
| 4,251,193 | 2/1981 | Minnis et al. . | |
| 4,386,891 | 6/1983 | Riefel et al. | 418/81 |

*Primary Examiner*—Timothy Thorpe
*Assistant Examiner*—Roland G. McAndrews, Jr.
*Attorney, Agent, or Firm*—Saul Schwartz

[57] ABSTRACT

A hydraulic pump having a flow control valve for recirculating a fraction of the discharge of a rotating group of the pump and an externally adjustable pressure relief valve. The flow control valve includes a cylindrical bore in a housing of the pump, a discharge passage intersecting the bore, a recirculation passage intersecting the bore, and a valve spool slideable in the bore. A valve body on the housing closes an open end of the cylindrical bore and cooperates with the valve spool in defining a spring chamber connected to the discharge passage. A spring in the spring chamber biases the valve spool to a position corresponding to zero recirculation. The relief valve includes a stepped bore in the valve body, a valve seat in the stepped bore, a valve element, a spring biasing the valve element against the valve seat, and a spherical metal spring seat interference fitted in the stepped bore. The spherical spring seat is plunged into the stepped bore while the pump is operating to compress the relief valve spring until a reaction force of the relief valve spring on the relief valve element induces a preselected pump relief pressure.

6 Claims, 2 Drawing Sheets

ADJUSTABLE RELIEF VALVE ARRANGEMENT FOR A MOTOR VEHICLE POWER STEERING HYDRAULIC PUMP SYSTEM

TECHNICAL FIELD

This invention relates to hydraulic pumps.

BACKGROUND OF THE INVENTION

U.S. Pat. Nos. 3,207,077 and 4,386,891, issued Sep. 21, 1965 and Jun. 7, 1983, respectively, and assigned to the assignee of this invention, describe motor vehicle power steering hydraulic pumps having flow control valves which recirculate a varying fraction of the discharge of a positive displacement rotating group of the pump to an inlet of the rotating group as the speed of the rotating group increases. The flow control valves include a valve spool which opens and closes a recirculation flow path of the pump in accordance with a pressure gradient across the valve spool proportional to flow rate. A relief pressure of the pump depends upon a force reaction or preload of a spring on the valve spool against a relief valve element on the valve spool. While such force reaction is easily established within close tolerance outside of the pump, relief pressures actually achieved have been observed to vary within a relatively broad range due to the accumulation of manufacturing tolerances within pumps. Reducing such manufacturing tolerances to correspondingly reduce the range of relief pressure variation increases the cost of manufacturing power steering pumps.

SUMMARY OF THE INVENTION

This invention is a new and improved motor vehicle power steering hydraulic pump having a flow control valve for recirculating a varying fraction of the discharge of a rotating group of the pump to an inlet of the rotating group and an externally adjustable pressure relief valve. The flow control valve includes a cylindrical bore in a housing of the pump, a discharge passage intersecting the bore, a recirculation passage intersecting the bore, and a valve spool slideable in the bore to control the quantity of fluid recirculated from the discharge passage to the recirculation passage. A screw threaded valve body on the housing closes an open end of the cylindrical bore and cooperates with the valve spool in defining a spring chamber connected to the discharge passage. A spring in the spring chamber biases the valve spool to a position corresponding to zero recirculation. The relief valve includes a stepped bore in the valve body accessible from outside of the pump and exposed to the spring chamber and to the recirculation passage, a valve seat in the stepped bore, a valve element having a closed position on the valve seat blocking the stepped bore, a spring, a spring seat, and means for varying the position of the spring seat on the valve body while the pump is operating to establish the magnitude of the relief pressure of the pump by adjusting the reaction force of the spring on the valve element. In a preferred embodiment, the spring seat is a metal sphere interference fitted in the stepped bore from outside of the pump.

DESCRIPTION OF THE PREFERRED EMBODIMENT

Figure 1:
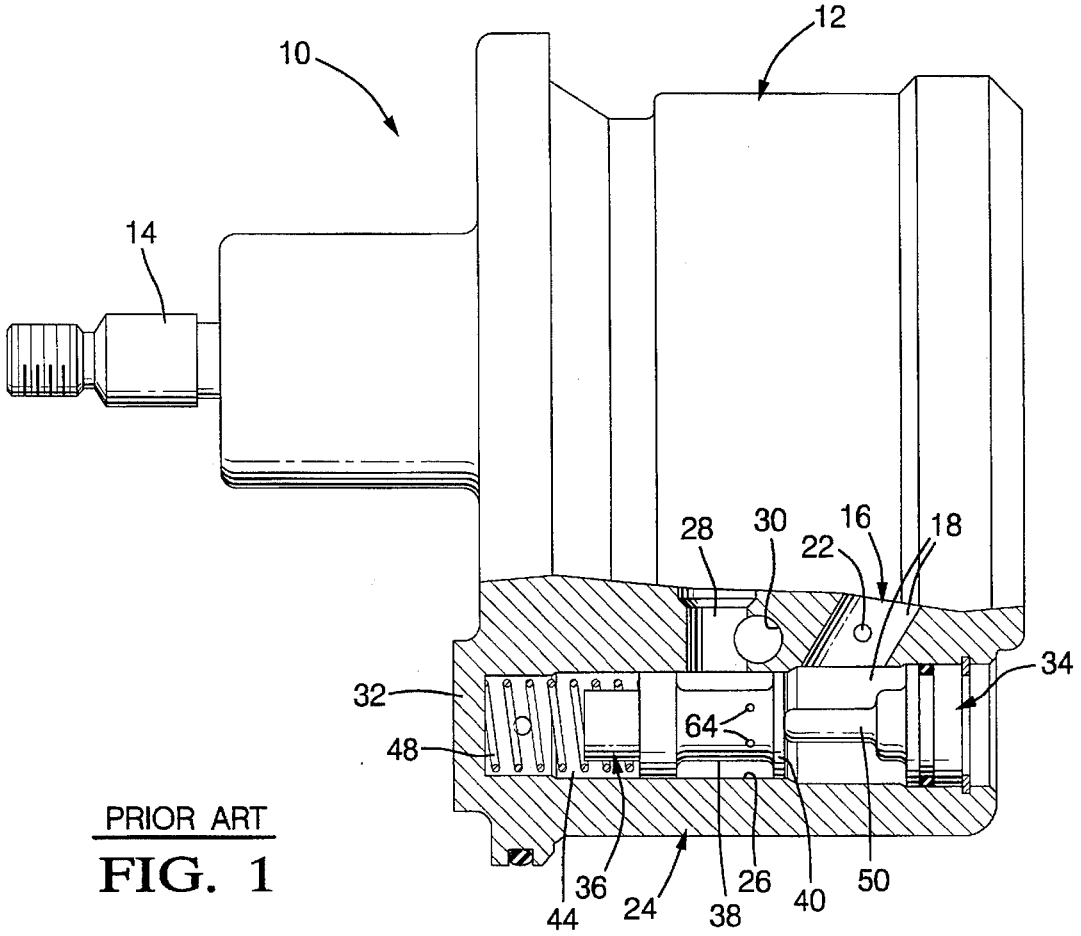
PRIOR ART FIG. 1
FIG. 1 is a partially broken-away elevational view of a prior art motor vehicle power steering hydraulic pump having a flow control valve and a pressure relief valve.
Figure 2:
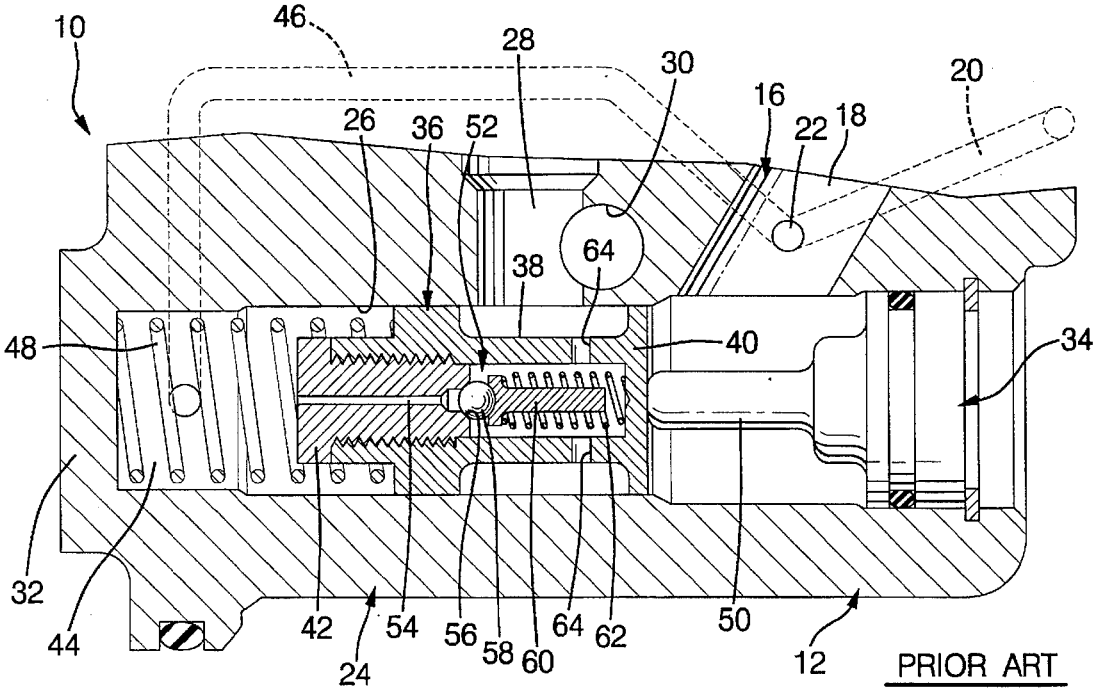
PRIOR ART FIG. 2
FIG. 2 is an enlarged view of a portion of FIG. 1.

Referring to FIGS. 1–2, a motor vehicle power steering hydraulic pump 10 includes a housing 12 and a shaft 14 rotatably supported on the housing. The shaft 14 is connected to a motor, not shown, of the motor vehicle such that the speed of the shaft in revolutions per minute (rpm) is proportional to the rpms of the motor. The shaft 14 drives a positive displacement rotating group, not shown, of the pump within the housing 12 such as the rotating group described in the aforesaid U.S. Pat. Nos. 3,027,077 and 4,386,891, which description is incorporated herein by reference. The rotating group discharges into a discharge passage 16 of the pump consisting of an upstream segment 18 and a schematically-represented downstream segment 20 on opposite sides of a flow-restricting orifice 22.

A flow control valve 24 of the pump 10 includes a bore 26 in the housing 12 intersected by the upstream segment 18 of the discharge passage 16 and by a recirculation passage 28 in the housing connected to an inlet, not shown, of the pump rotating group and to a reservoir port 30. The bore 26 is closed at one end by an integral web 32 of the housing 12 and at the other end by a stopper 34.

A tubular flow control valve spool 36 slideable in the bore 26 has an annular groove 38 facing the bore and is closed at one end by an end wall 40 and at the other end by an insert 42 screw threaded into the spool. The end of the valve spool defined by the insert 42 cooperates with the web 32 of the housing 12 in defining a spring chamber 44 in the bore 26. The spring chamber 44 communicates with the downstream segment 20 of the discharge passage 16 through a schematically-represented branch passage 46. A spring 48 in the spring chamber 46 biases the valve spool 36 toward a closed position, FIGS. 1–2, defined by engagement of the end wall 40 of the spool against an abutment 50 on the stopper 34.

At low rpm of the shaft 14, the rate of flow of fluid from the pump rotating group is low enough that only a small pressure gradient is induced by the orifice 22 between the upstream and downstream segments 18, 20 of the discharge passage 16. In that circumstance, the spring 48 holds the valve spool in its closed position so that all of the discharge from the pump rotating group flows out of the pump through the discharge passage 16.

As shaft rpm and the flow rate of fluid from the pump rotating group increase, the pressure gradient between the upstream and downstream segments 18, 20 of the discharge passage increases. The pressure gradient, applied across the valve spool 36 through the upstream segment 18 of the discharge passage and the branch passage 46, induces linear translation of the valve spool to an open position, not shown, exposing the recirculation passage to the discharge passage so that a fraction of the discharge of the rotating group of the pump recirculates directly back to the inlet of the rotating group.

A relief valve 52, FIG. 2, of the pump 10 on the valve spool 36 includes a passage 54 in the insert 42 exposed to the spring chamber 44, a circular valve seat 56 on the insert around the passage 54, a spherical valve element 58, a guide 60 cradling the valve element 58, a spring 62 between the guide 60 and the spool 36, and a plurality of perforations 64 in the wall of the spool at the bottom of the annular groove 38. The spring 62 biases the valve element 58 to a closed position, FIGS. 1–2, on the valve seat 56 blocking the passage 54. Fluid pressure in the spring chamber 44 reacts against the valve element 58 in the opposite direction through the passage 54. The interior of the valve spool 36 behind the valve element 58 communicates continuously with the recirculation passage 28 through the perforations 64 and the annular groove 38.

The relief pressure of the pump depends upon the magnitude of the reaction force of the spring 62 on the valve element 58. When the net force on the valve element 58 in the opposite direction attributable to fluid pressure in the discharge passage 16 exceeds such reaction force, the valve element 58 translates linearly to an open position, not shown, remote from the valve seat 56 in which the passage 54 is unblocked. In that circumstance, fluid from the discharge passage exhausts to the recirculation passage 28 through the spring chamber 44, the passage 54 in the screw threaded insert 42, the perforations 64, and the annular groove 38.

The magnitude of the reaction force of the spring 62 on the valve element 58 is established by screwing the insert 42 on the spool 36 into or out of the spool to change the amount by which the spring is compressed between the valve element and the spool. The amount of compression of the spring 62 and the corresponding relief pressure of the pump 10 cannot be changed when the pump is operating. Instead, the amount of compression of the spring 62 is usually established in an apparatus separate from the pump before the spool is inserted in the bore 26. While the amount of compression of the spring 62 to achieve a desired relief pressure can be accurately established in such separate apparatus, it has been observed that the actual relief pressure of a pump after assembly may be different than the desired relief pressure due to the influence of dimensional tolerance accumulation within the pump. Unacceptably large differences can be corrected only through the expensive process of partially disassembling the pump to obtain access to the screw threaded insert 42.

Figure 3:
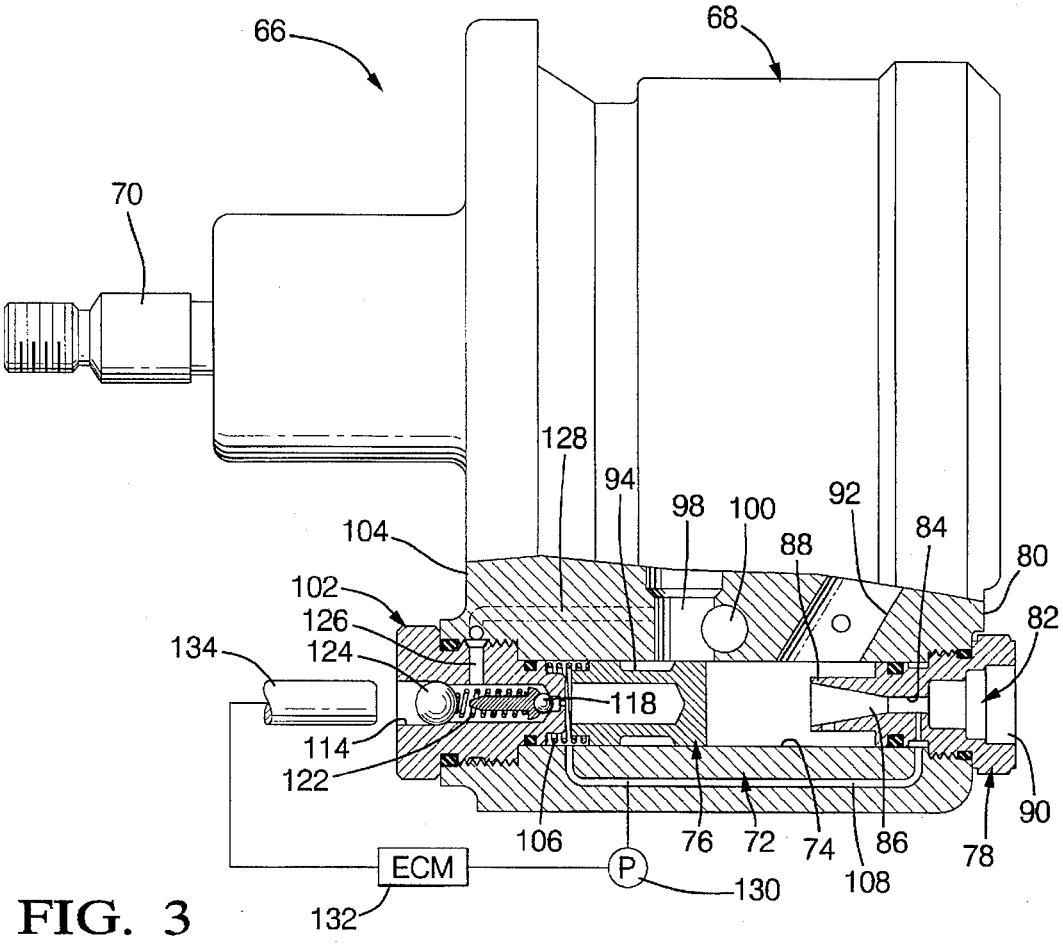
FIG. 3 is a partially broken-away elevational view of a motor vehicle power steering hydraulic pump according to this invention having a flow control valve and a pressure relief valve.
Figure 4:
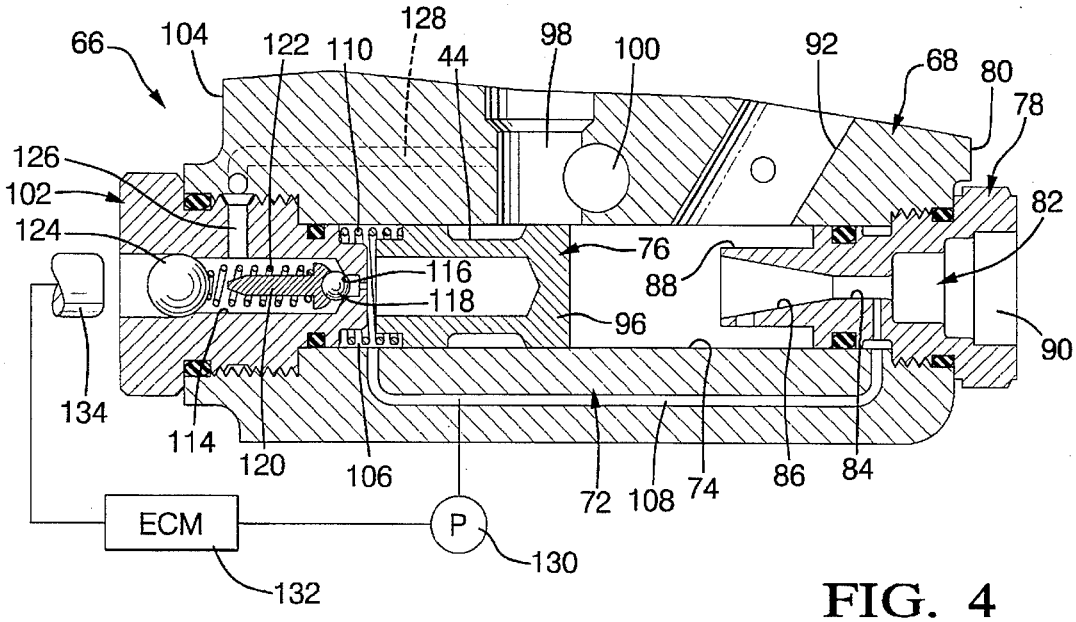
FIG. 4 is an enlarged view of a portion of FIG. 3.

Referring to FIGS. 3–4, a hydraulic power steering pump 66 according to this invention includes a housing 68 and a shaft 70 rotatably supported on the housing. The shaft 70 is connected to a motor, not shown, of a motor vehicle such that the rpm of the shaft is proportional to the rpm of the motor. The shaft 70 drives a positive displacement rotating group, not shown, of the pump within the housing 68 such as the rotating group described in the aforesaid U.S. Pat. Nos. 3,027,077 and 4,386,891.

A flow control valve 72 of the pump 66 includes a bore 74 in the housing 68 and a tubular valve spool 76 slideable in the bore. A union 78 is screwed into an end of the bore 74 open through a side 80 of the housing and sealed against leakage by a pair of seal rings. A passage 82 through the union 78 includes a throat 84 between an inboard portion 86 within a tubular abutment 88 of the union in the bore 74 and an outboard portion 90 at which a conduit, not shown, is attached for conveying fluid from the pump to a power steering control valve.

The rotating group of the pump discharges into a passage 92 in the housing 68 which intersects the bore 74 between the valve spool 76 and the tubular abutment 88. The passage 92 in the housing 68 and the passage 82 in the union 78 constitute a discharge passage of the pump. The throat 84 constitutes a restriction in the discharge passage. The passage 92 and the inboard portion 86 of the passage 82 constitute an upstream segment of the discharge passage. The outboard portion 90 of the passage 82 constitutes a downstream segment of the discharge passage.

The tubular valve spool 76 has an annular groove 94 facing the bore 74 and is closed at one end by an end wall 96. The valve spool 76 has a closed position, not shown, defined by engagement of the end wall 96 against the tubular abutment 88 on the union 78 in which the valve spool blocks communication between the discharge passage and a recirculation passage 98 in the housing 68 which also intersects the bore. The recirculation passage 98 is connected to an inlet, not shown, of the rotating group of the pump and to a reservoir port 100. In an open position of the valve spool 76, FIGS. 3–4, the valve spool exposes the recirculation passage 98 to the discharge passage for recirculation of a fraction of the discharge of the rotating group directly back to its inlet.

A screw threaded valve body 102 screwed into the bore 74 through a side 104 of the housing 68 closes the corresponding end of the bore and is sealed against fluid leakage by a plurality of seal rings. The valve body 102 cooperates with the valve spool 76 in defining a spring chamber 106 in the bore 74. The spring chamber 106 communicates with the discharge passage of the pump through a schematically represented branch passage 108 between the spring chamber and the throat 84. A spring 110 in the spring chamber 106 biases the valve spool 76 toward its closed position.

At low rpm of the shaft 70, the rate of flow of fluid from the pump rotating group is low enough that only a small pressure gradient is induced by the throat 84 between the upstream and downstream segments of the discharge passage. In that circumstance, the spring 110 holds the valve spool in its closed position so that all of the discharge from the pump rotating group flows out of the pump through the discharge passage.

As shaft rpm and discharge flow rate from the pump rotating group increase, the pressure gradient between the upstream and downstream segments of the discharge passage increases. The pressure gradient, applied across the valve spool 76 through the upstream segment of the discharge passage and the branch passage 108, induces linear translation of the valve spool to an open position exposing the recirculation passage 98 to the discharge passage so that a fraction of the discharge of the rotating group of the pump recirculates directly back to its inlet.

A relief valve of the pump 66 accessible from outside of the housing 68 includes a stepped bore 114 in the valve body 102, a circular valve seat 116 defined by an edge of an annular shoulder of the stepped bore 114, a spherical valve element 118, a guide 120 cradling the valve element 118, and a spring 122 around and seated at one end against the guide 120. The other end of the spring 122 is seated against a metal sphere 124 interference fitted in the stepped bore 114 from outside of the housing 68. The spring 122 biases the valve element 118 to a closed position, FIGS. 3–4, on the valve seat 116 blocking the stepped bore 114. Fluid pressure in the spring chamber 106 reacts against the valve element 118 in the opposite direction through a small diameter end of the stepped bore. The stepped bore 114, between the valve seat 116 and the sphere 124, communicates continuously with the recirculation passage 98 through a relief passage 126 in the valve body and a schematically represented relief passage 128 in the housing 68.

The relief pressure of the pump depends upon the magnitude of the reaction force of the spring 122 on the valve element 118. When the net force on the valve element 118 in the opposite direction attributable to fluid pressure in the discharge passage exceeds such reaction force, the valve element translates linearly to an open position, not shown, remote from the valve seat 116 in which the stepped bore 114 between the valve seat 116 and the sphere 124 is unblocked. In that circumstance, fluid from the discharge passage exhausts to the recirculation passage 98 through the spring chamber 106, the stepped bore 114 in the valve body 102, and the relief passages 126, 128.

The relief pressure of the pump 66 is established at a preselected magnitude as follows. The pump is assembled with the metal sphere 124 initially at a position in which the net force of the spring 122 on the valve element 118 is less than required to achieve the preselected relief pressure. The inlet of the rotating group is connected to a source of fluid, the discharge passage is blocked downstream of the throat 84, and the shaft 70 is rotated to cause the rotating group of the pump to discharge fluid into the discharge passage. Fluid pressure in the discharge passage and in the spring chamber 106 quickly increases to a magnitude at which the net pressure force on the valve element 118 exceeds the reaction force of the spring 122 on the valve element so that the valve element linearly translates to its open position.

A schematically represented pressure transducer 130 monitors the pressure in the spring chamber 106. An electronic control module 132 actuates a ram 134 to force the sphere 124 into the stepped bore 114 when fluid pressure in the spring chamber is below the preselected magnitude. As the sphere 124 penetrates deeper into the stepped bore, the spring 122 is further compressed to increase its reaction force on the valve element 118. The magnitude of fluid pressure in the spring chamber 106 increases concurrently until achieving the preselected relief pressure of the pump, whereupon the control module terminates the stroke of the ram and withdraws the latter from the stepped bore. The metal sphere 124 is retained in its corresponding position by interference with the stepped bore 114, which interference also prevents leakage around the sphere.

Importantly, the metal sphere is accessible from outside of the pump housing 68 when the pump is operating. By virtue of such exposure, the relief pressure of the pump is established while the pump is operating, i.e., dynamically, and independently of the aforesaid dimensional tolerance accumulations thereby to substantially eliminate the observed variation in relief pressure in prior power steering hydraulic pumps.

We claim:

1. A hydraulic pump including a discharge passage in a housing of said pump, a recirculation passage in said pump housing, an orifice means in said discharge passage operative to induce a pressure gradient between an upstream segment of said discharge passage and a downstream segment of said discharge passage proportional to a fluid flow rate in said discharge passage, a flow control valve means responsive to increases in the magnitude of said pressure gradient to progressively expose said recirculation passage to said discharge passage, and a pressure relief valve means operative to connect said discharge passage to said recirculation passage when the magnitude of the fluid pressure in said discharge passage exceeds a predetermined relief pressure, characterized in that said pressure relief valve means comprises:

a relief passage means in said pump housing operative to define a relief passage between said discharge passage and said recirculation passage, a valve seat on said pump housing around said relief passage, a valve element supported on said pump housing for linear translation between a closed position on said valve seat blocking said relief passage and an open position remote from said valve seat in which said relief passage is unblocked, a relief valve spring having a first end connected to said valve element, a spring seat connected to a second end of said relief valve spring, and a mounting means operative to mount said spring seat on said pump housing for linear translation in response to a force applied to said spring seat from outside of said pump housing during operation of said pump in a direction operative to increase a reaction force of said relief valve spring on said valve element.

2. The hydraulic pump recited in claim 1 wherein said flow control valve means comprises:

a bore in said pump housing, a valve spool slideable linearly in said bore between a closed position in which said valve spool separates said discharge passage from said recirculation passage and an open position in which said valve spool exposes said recirculation passage to said discharge passage and cooperating with said pump housing in defining a spring chamber in said bore, a first passage means communicating said upstream segment of said discharge passage to said bore so that fluid pressure in said upstream segment of said discharge passage reacts against said valve spool in a direction urging said valve spool toward said open position, a flow control valve spring in said spring chamber biasing said valve spool toward said closed position, and a second passage means communicating said spring chamber to said downstream segment of said discharge passage so that said pressure gradient is applied across said valve spool.

3. The hydraulic pump recited in claim 2 wherein said valve seat on said pump housing around said relief passage comprises:

a valve body rigidly attached to said pump housing at an end of said bore in said pump housing, and a stepped bore in said valve body intersecting said spring chamber and accessible from outside of said pump housing having an annular shoulder defining said valve seat.

4. The hydraulic pump recited in claim 3 wherein said relief valve element comprises:

a metal sphere.

5. The hydraulic pump recited in claim 4 wherein said spring seat connected to said relief valve spring comprises:

a metal sphere.

6. The hydraulic pump recited in claim 5 wherein said mounting means operative to mount said spring seat on said pump housing for linear translation in response to a force applied to said spring seat from outside of said pump housing comprises:

an interference fit between said spherical metal spring seat and said stepped bore.

* * * * *